US007246624B2

(12) United States Patent
Cantrell et al.

(10) Patent No.: US 7,246,624 B2
(45) Date of Patent: Jul. 24, 2007

(54) POT AND PAN WASHING MACHINE, COMPONENTS, AND METHODS OF WASHING ITEMS

(75) Inventors: John W. Cantrell, Leawood, KS (US); John Inch, Kansas City, MO (US); Mark Churchill, Blue Springs, MO (US); Dave Stockdale, Lee's Summit, MO (US); Peter A. Corpenny, Lee's Summit, MO (US)

(73) Assignee: Metcraft, Inc., Grandview, MO (US)

( * ) Notice: Subject to any disclaimer, the term of this patent is extended or adjusted under 35 U.S.C. 154(b) by 621 days.

(21) Appl. No.: 10/744,666

(22) Filed: Dec. 23, 2003

(65) Prior Publication Data

US 2004/0244822 A1 Dec. 9, 2004

Related U.S. Application Data

(60) Continuation-in-part of application No. 09/947,484, filed on Sep. 6, 2001, now Pat. No. 6,739,348, and a continuation-in-part of application No. 10/724,486, filed on Nov. 26, 2003, now Pat. No. 6,976,496, which is a division of application No. 09/947,485, filed on Sep. 6, 2001, now abandoned.

(51) Int. Cl.
*B08B 9/20* (2006.01)
*B08B 3/00* (2006.01)

(52) U.S. Cl. ..... 134/25.2; 134/56 D; 134/57 D; 134/110

(58) Field of Classification Search ..... 134/56 R, 134/56 D, 57 R, 57 D, 104.3, 105, 107, 108, 134/191, 195, 198, 199, 89, 90, 188, 194, 134/25.2, 110; 210/416.1, 17
See application file for complete search history.

(56) References Cited

U.S. PATENT DOCUMENTS 4,566,970 A * 1/1986 Piai et al. ..... 210/409
4,773,436 A * 9/1988 Cantrell et al. ..... 134/108
5,927,309 A * 7/1999 Hoover et al. ..... 134/195

* cited by examiner

*Primary Examiner*—Michael Barr
*Assistant Examiner*—Jason Heckert
(74) *Attorney, Agent, or Firm*—Sonnenschein Nath & Rosenthal LLP; Bryan P. Stanley

(57) ABSTRACT

An improved pot and pan washing machine is provided including a low suction intake manifold and a partition for capturing a substantial portion of the wash action of the washing machine within a segregated area. The intake manifold of the instant invention includes a plurality of voids having a void concentration that increases as the distance from the source of suction (such as a pump or intake inlet) increases. The partition (or divider) of the instant invention can be removed and repositioned within the wash tank through the use of channels along the walls of the wash tank that receive the partition.

13 Claims, 5 Drawing Sheets

POT AND PAN WASHING MACHINE, COMPONENTS, AND METHODS OF WASHING ITEMS

CROSS-REFERENCE TO RELATED APPLICATIONS

This is a continuation-in-part of U.S. application Ser. No. 09/947,484 filed Sep. 6, 2001, now U.S. Pat. No. 6,739,348, and a continuation-in-part of U.S. application Ser. No. 10/724,486 filed Nov. 26, 2003, now U.S. Pat. No. 6,976, 496 which is a divisional of U.S. application Ser. No. 09/947,485 filed Sep. 6, 2001, now abandoned, the disclosures of which are incorporated herein by reference in their entirety.

FIELD OF THE INVENTION

The present invention relates to improvements in a pot and pan washing machine. More specifically the present invention relates to improvements within the wash tank portion of a pot and pan washing machine, including an improved intake manifold and, a divider for isolating a portion of the wash tank, and methods for washing pots, pans, utensils and other similar items.

BACKGROUND OF THE INVENTION

Pot and pan washing machines, of the type used in restaurants, institutions and other eating facilities often involve a large wash tank or basin in which water is circulated about the pots and pans to provide a washing action. One such machine is described in U.S. Pat. No. 4,773,436 issued to Cantrell et al., the specification of which is incorporated herein by reference. The machine of Cantrell includes a wash tank with multiple jets evenly spaced apart at an elevated position along the rear wall of the wash tank. The tank is filled with water to a level above the position of the jets. Pots and pans are placed in the wash tank, and a pump is activated to draw water from within the wash tank and direct it through the jets to create a jet stream. Each jet directs its jet stream toward the bottom wall of the wash tank, the bottom wall then deflects the jet stream upward and towards the front wall of the tank. The front wall then deflects the upward moving jet stream towards the rear wall of the tank, and the rear wall deflects the jet stream downward and back towards the front wall along the bottom wall. The combination of deflections of the jet stream from the bottom, front and rear walls provides a rolling washing action within the wash tank.

The basic components of the wash tank of the pot and pan washing machine of the prior art are shown in FIG. 1. Wash tank 10 includes end walls 12 and 14, rear side wall 16, front side wall 18 and bottom wall 19. A pump can be attached to either end wall; in the embodiment shown in FIG. 1, pump 50 is attached to right end wall 14. An impeller located within pump 50 is driven by electric motor 56. The impeller draws fluid into pump inlet 52 through an intake port (not shown) located in end wall 14. The fluid is then discharged from the pump through pump outlet 54 and into outlet manifold 60. Outlet manifold 60 includes a ninety degree turn, and several other turns, to direct the fluid across the back side of rear wall 16 and out jet nozzles 20 which are protruding through and extending from rear wall 16. The intake port associated with pump inlet 52 is covered by perforated intake manifold 30. Intake manifold 30 includes handle 36 and is removably supported within wash tank 10 for easy cleaning. Intake manifold 30 fits tightly between outer runner 32 and inner runner 34, each of which extends vertically from bottom wall 19. Heating element 40 is positioned between intake manifold 30 and end wall 14 for its protection and to maximize the use of space.

Although the prior art pot and pan washing machine disclosed in U.S. Pat. No. 4,773,436 provides an exceptional wash action, many of the components discussed above hinder the overall efficiency and performance of the machine. The inventions disclosed in co-pending U.S. application Ser. No. 09/947,484 provide components that greatly increase the overall efficiency and performance of the machine, including an improved intake manifold positioned along the rear wall of the machine as shown in FIG. 2. The invention disclosed in U.S. application Ser. No. 09/947,484 provides a scaleable, self-cleaning intake manifold that has a generally linear intake path. Nevertheless, the improved intake manifold itself has several disadvantages that result in a reduction of efficiency and performance.

The main problem with the prior art pump intakes in a pot washing system is that a fluid will take the path of least resistance to the inlet of the pump. Therefore, the volume of fluid nearest the pump intake will be pulled in at a much greater rate than the volume farthest away from the intake. This "sucking" action creates problems in pot and pan washing systems as it will eventually draw the wares toward the intake-end of the wash sink (a phenomenon called "pan migration") where they can potentially "pile up", blocking the inlet manifold and starving the pump by restricting the fluid flow to the inlet. This occurs on all existing pot and pan washing systems, including systems utilizing linear intake manifold 130 shown in FIG. 2, which includes holes evenly spaced across the entire surface of the intake manifold. In the case of intake manifold 130 the even spacing of holes result in over 90% of the fluid transfer from the sink to pump 150 takes place in the first 50% of the intake, creating a large vacuum due to the suction of the water through holes in the intake. In addition, the fluid entering pump 150 is fairly turbulent as the path of most of the fluid must turn a sharp angle (generally ninety degrees) almost immediately from the point in which the fluid enters intake manifold 130 to the point in which the fluid enters pump 150. This too reducing the efficiency and performance of pump 150.

In order to provide the most efficient wash action within the entire volume of the wash sink it is desirable to develop a pump intake manifold that will introduce fluid to the pump inlet in such a way as to minimize the vacuum effect of the pump (as it draws in the fluid) and to minimize the turbulence of the fluid prior to reaching the pump inlet.

Although a machine that employs a wash tank and jet stream of the type described above is extremely useful for washing pots and pans, it is less desirable for washing smaller items such as utensils. In addition, it is difficult to separate items that require different levels of cleansing within the single wash tank of the above-described washing machine. In an attempt to provide a segregated wash area for items such as utensils, utensil baskets are often located within the wash tank. The invention disclosed in U.S. application Ser. No. 09/947,485 provides a powered utensil basket that captures a jet stream from the washing machine in which the basket is located to maintain the washing action of the machine within the basket. Although the powered utensil basket does provide a segregated washing area for utensils and other items that is removable from the washing machine, the basket itself is rather bulky and often not utilized in operation. Therefore, it is desirable to provide a segregated washing area within a wash tank that does not require the placement of a bulky utensil basket in the wash tank, while at the same time maintaining the wash action of the machine.

SUMMARY OF THE INVENTION

A principal object of the present invention is to provide a cost efficient pot and pan washing machine having exceptional efficiency and performance characteristics. Another object of the present invention is to increase the efficiency and performance of the pot and pan washing machine through the use of an inventive intake manifold that minimizes the pressure differential between the interior (non wash take side) of the intake manifold and the exterior (wash tank side) of the manifold, and that minimizes turbulence in the fluid path. Another object of the instant invention is to utilize the "dead" space in the back (along the rear wall) of the wash sink where minimal "wash action" takes place. Yet another object of the instant invention is to provide an intake manifold that has the least amount of pressure differential at the intake wall in order to minimize the possibility of items being pulled down to the manifold and being held in place due to the vacuum created by the difference in pressure.

Yet another object of the instant invention is to provide a segregated washing area within a wash tank that maintains the wash action of the machine.

According to the above described objects of the instant invention, a pot and pan washing machine is provided including an improved intake manifold and a partition (or divider). The intake manifold of the instant invention is positioned along the length of the rear wall of the washing machine. This position provides several unique advantages, which are discussed in U.S. application Ser. No. 09/947,484. In addition, the surface of the intake manifold of the instant invention includes a hole (or void) pattern that facilitates uniform suction along the entire length of the manifold.

The hole pattern of the instant is accomplished by gradually introducing holes in the intake and increasing the number of holes as the distance from the pump increases in order to spread the potential for vacuum across the length of the intake. In the preferred embodiment a "long" or "large" intake surface is utilized as utilizing a smaller surface area would make it more difficult to create enough openings, using the appropriate pattern(s), to allow for a balanced suction throughout the length of the intake.

In the preferred embodiment of the instant invention, number of holes (i.e. the void concentration) increases as the distance from the pump inlet increases. This results in a more uniform, and minimal, vacuum across the entire length of the intake which eliminates the potential for items, such as small lids, small trays, dish towels, etc., to be sucked down and held against the surface of the intake. As there will always be some difference in pressure at the voids there will never be a true "zero vacuum"; however the pattern of the instant invention comes very close.

Another important benefit of the varying hole concentration of the instant invention is that the pattern helps to create a linear "chute" for the water to travel through prior to entering the pump. This helps align the water to create a more laminar flow into the pump, thus creating less turbulence, which results in more efficient pump operation.

In a preferred embodiment of the instant invention, a minimum void concentration is provided near the suction source (the intake manifold inlet). This minimum void concentration is provided to eliminate swirling (whirlpool or eddy) that is created when the jets of the washing machine introduce fluid to an area in which no fluid is removed.

An additional feature of a preferred embodiment of the instant invention is the inclusion of a maximum void concentration within a predetermined area. The purpose of the maximum void concentration is to prevent items, such as dish towels, from sticking to the intake manifold during operation. The maximum void concentration for an area is based upon the amount of suction that is desired across that area. Thus, as the suction from the pump decreases as the distance from the intake inlet increases, the maximum void concentration will increase for a given surface area. In addition to the maximum void concentration, the voids of the intake manifold of a preferred embodiment have a maximum area to prevent small items and debris from being drawn into the intake manifold.

The divider of the instant invention provides a segregated washing area within the wash tank of the pot and pan washing machine, in which the washing action of the machine is maintained. The divider is removable and repositionable via a series of channels located along the walls of the wash tank.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF A PREFERRED EMBODIMENT

Figure 1:
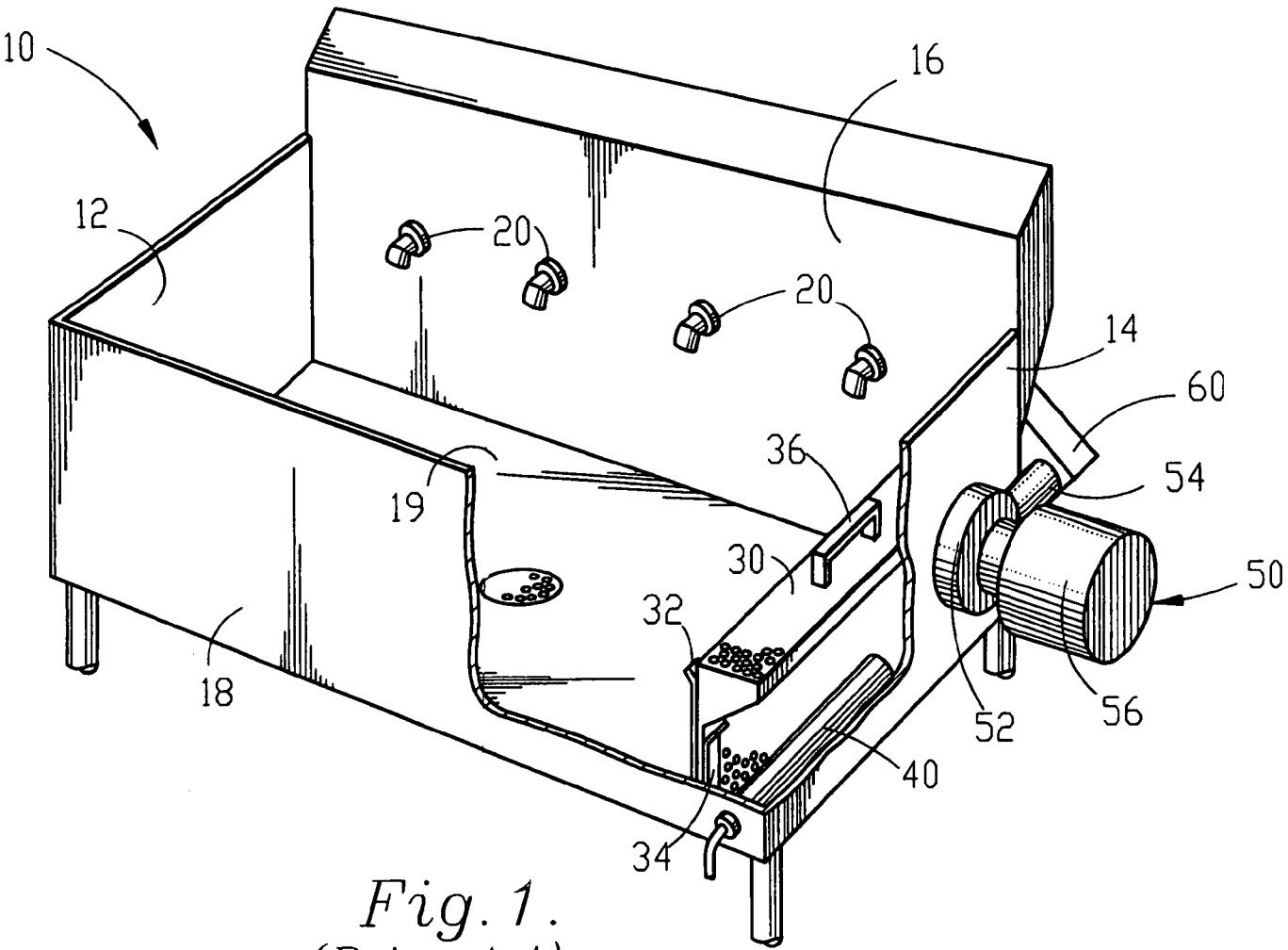
Fig. 1. (Prior Art)
FIG. 1 is a perspective view from above of a prior art pot and pan washing machine with a portion of the front and one side wall of the wash tank cut away to better illustrate certain interior construction details.

Referring to the drawing figures, therein is shown an optimum form of the subject pot and pan washing machine with essentially all features usable to increase performance, versatility and efficiency therewithin. Preferred embodiments of the present invention are hereinafter described with reference to the accompanying drawings.

The operation of the pot and pan washing machine described hereinafter is substantially similar to the operation of the prior art machine described above. The instant invention provides significant features that increase the performance, versatility and efficiency of the pot and pan washing machine.

Figure 3:
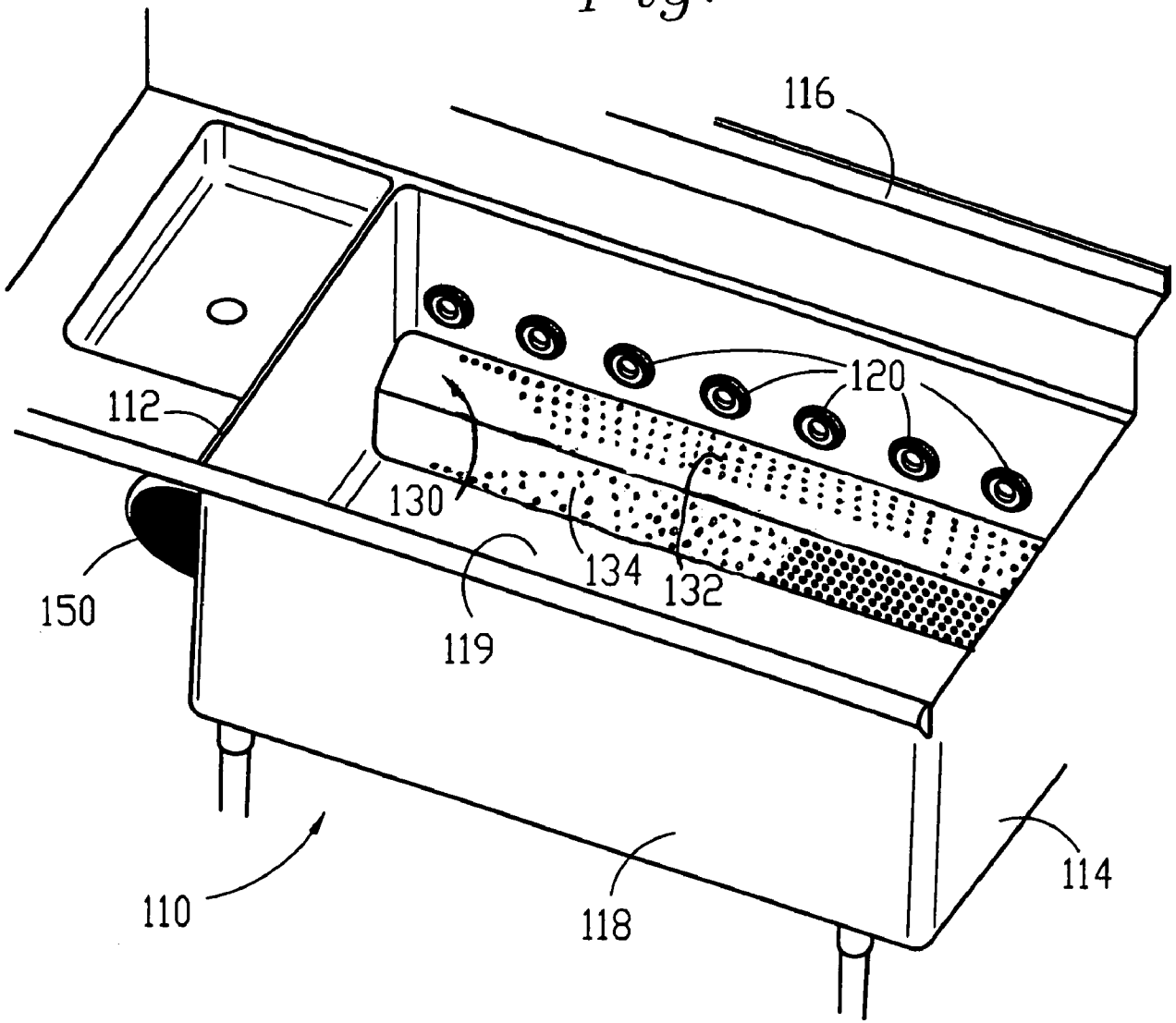
FIG. 3 is a fragmentary perspective view from above of the pot and pan washing machine of FIG. 2 utilizing the intake manifold of the instant invention.

Referring to FIG. 3, a preferred embodiment of the wash tank of the inventive pot and pan washing machine is shown. The wash tank/basin of the instant invention is constructed in essentially the same manner as the wash tanks of the prior art. Wash tank 110 includes left end wall 112, right end wall 114, rear side wall 116, front side wall 118 and bottom wall 119 constructed in the same or similar manner, and of the same or similar materials as the wash tank of the prior art. FIG. 3 shows the components of the pot and pan washing machine as they are located in association with wash tank 110. Pump 150 is attached to left end wall 112 in the embodiment shown in FIG. 3. As has been discussed with respect to the prior art, pump 150 can be attached to either left end wall 112 or right end wall 114 of wash tank 110. In addition it is understood that pump 150 could be attached to any other wall of the wash tank, or otherwise located separate from the wash tank and connected to the interior of the wash tank via a hose or other piping. Flush mounted jet nozzles 120 are mounted along rear wall 116 equally spaced apart from one another. Intake manifold 130 is mounted within wash tank 110 along the bottom portion of rear wall 116, below nozzles 120.

Intake manifold 130 is shown installed within wash tank 110 in FIG. 3. Intake manifold 130 includes an upper portion 132 extending outwardly from rear wall 116 toward front wall 118, and lower portion 134 extending from the front end of upper portion 132. In a preferred embodiment, the upper portion of intake manifold 130 is angled downward from rear wall 116. The downward angle of the upper portion of intake manifold 130 corresponds to the downward angle of jet nozzle 120 which directs a fluid path toward the front portion of bottom wall 119 as described above with respect to the prior art washing machine.

Figure 2:
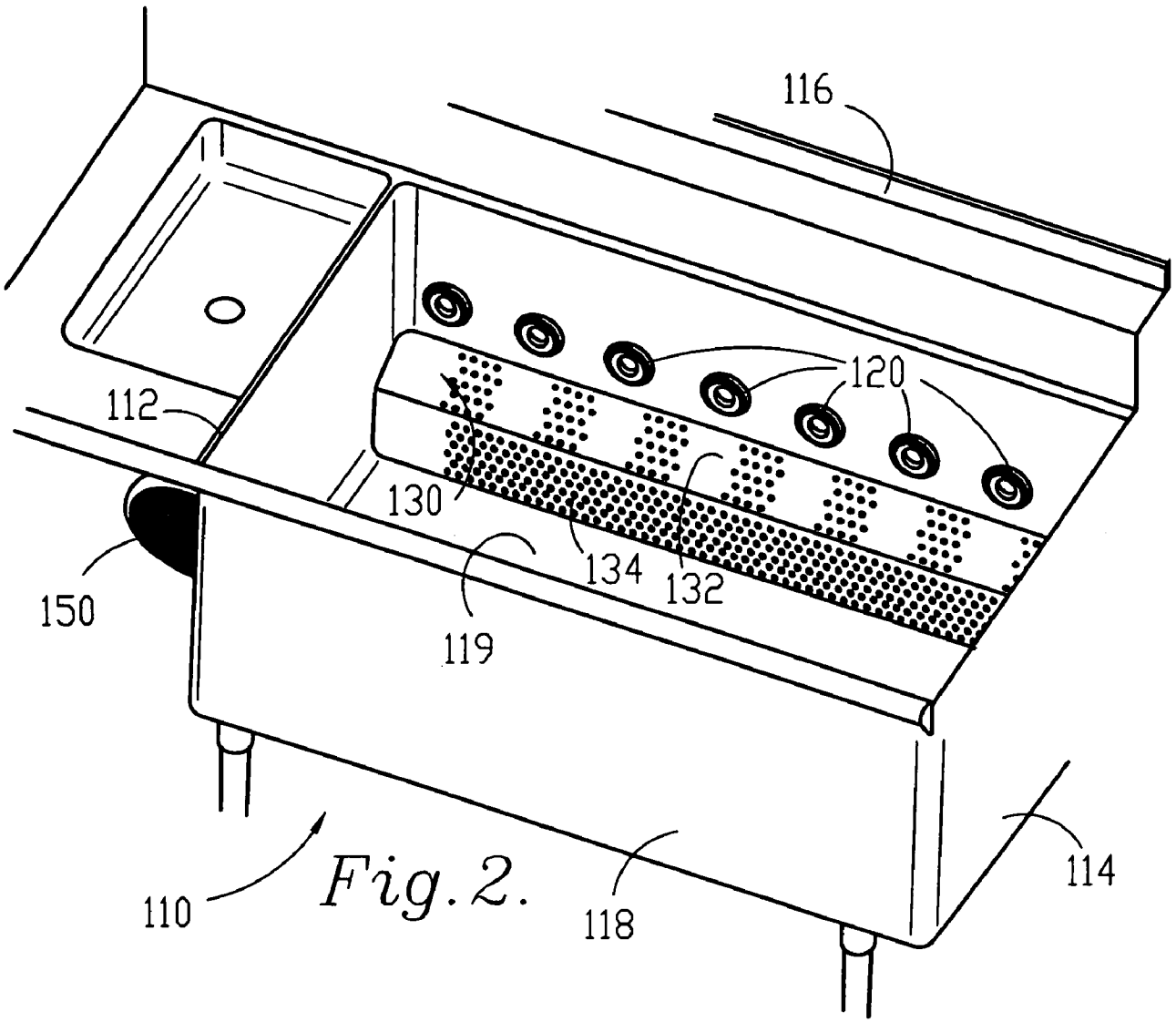
FIG. 2 is a fragmentary perspective view from above of another pot and pan washing machine showing a generally linear intake manifold including evenly spaced perforations along the length of the intake surface.

Portions of the intake manifold are perforated to allow fluid to be drawn into manifold 130 by the pump. The amount of perforations can vary depending upon the amount of vacuum desired and the flow rate of the pump. The void concentration, i.e. the number of perforations or the total area of void versus the total surface area for a given section of the intake manifold, increases as the distance from the point of suction increases. In the case of the embodiment shown in FIG. 2, the point of suction is pump 150 or the intake inlet of the intake manifold which extends through end wall 112 and is connected to the pump. Increasing the number and size of the perforations will result in a decreased vacuum and increased efficiency. In a preferred embodiment, a maximum void size for each individual perforation is utilized to prevent debris and small items from entering the intake manifold. Perforations can be located only on upper portion 132, only on lower portion 134, or on both upper portion 132 and lower portion 134; in the preferred embodiment however it is desirable to include perforations an both upper portion 132 and lower portion 134 so as to maximize the surface area over which perforations can be located and thus decreasing the pressure differential for any given perforation.

In the preferred embodiment shown in FIG. 3, a minimum void concentration is provided near pump 150 to prevent a swirling, whirlpool, or eddy effect that would be caused by the jet nearest the pump introducing fluid into the region of the wash tank without any fluid being removed. An additional feature of a preferred embodiment of the instant invention shown in FIG. 3 is the inclusion of a maximum void concentration within a predetermined area. The purpose of the maximum void concentration is to prevent items, such as dish towels, from sticking to the intake manifold during operation. The maximum void concentration for an area is based upon the amount of suction that is desired across that area. Thus, as the suction from pump 150 decreases as the distance from the intake inlet increases, the maximum void concentration will increase for a given surface area. In addition to the maximum void concentration, the voids of the intake manifold of a preferred embodiment have a maximum area to prevent small items and debris from being drawn into the intake manifold.

In will be appreciated that intake manifold 130 obtains an enclosed interior within manifold portions 132 and 134, rear side wall 116, end walls 112 and 114, and bottom wall 119. Thus, the walls of the pot and pan washing machine also act as walls for the intake manifold, and the inlet (not shown) that extends through end wall 112 from pump 150 is the inlet to intake manifold 130. Nevertheless, it is understood that in alternative embodiments of the instant invention, the inlet to the intake manifold can be located in any of the walls of the washing machine, or even be separate from the walls of the machine.

The jet nozzles of the embodiment shown in FIG. 3 are flush mounted to rear wall 116 of the wash tank. An annular outer ring is mounted to rear wall 116 on the inner side of the wash tank. A directing tube extends from an inner circumference of the outer ring, through a hole in rear wall 116 and into an outlet manifold. The directing tube diverts the fluid path moving through the outlet manifold into a jet stream. The directing tube has a predetermined angle to direct the jet stream toward the front portion of bottom wall 119.

In a preferred embodiment of the instant invention, upper portion 132 of the intake manifold is positioned within the fluid path of nozzle 120. The jet stream from flush mounted nozzle 120 impacts the intake manifold at a position generally near rear wall 116 and skims across the surface of the upper portion of intake manifold 130. Intake manifold 130 is thereby self-cleaning in that jet nozzle 120 blows any debris away from the perforations of the intake manifold. The preferred embodiment of the intake manifold shown in FIG. 3 includes the upper and lower portions that are connected to rear wall 116 and bottom wall 119, respectively to form an inclosure within the intake manifold. Additional walls can be utilized if it is not desired to have the intake manifold connected to both the rear and bottom walls. In addition, the intake manifold can be located substantially at the exterior of the wash tank, thus including an intake surface that extends into the interior of the wash tank. The intake manifold can be made removable in a manner similar to that of the prior art; however, since the preferred embodiment is self-cleaning (described above), the inventive intake manifold can be permanently connected within the wash tank using any means known in the art. A heater can be positioned within the intake inclosure for safety and protection.

In operation, wash tank 110 is filled full of water, soap and pots and pans to a level above jet nozzles 120. The soapy water, or fluid is drawn through the perforations (voids or holes) in intake manifold 130 by pump 150. The fluid enters pump 150 through an intake inlet in a first direction that is generally parallel to rear wall 116. The fluid is discharged from the pump through an outlet into an outlet manifold. Jet nozzle 120 diverts the fluid from the outlet manifold into a jet stream directed toward the front portion of bottom wall 119. The jet stream skims across the upper portion of intake manifold 130 as it travels from the jet nozzle to the bottom wall of the wash tank. The jet stream is deflected from bottom wall into a wash action in a manner substantially similar to that of the prior art.

Divider 210 of the instant invention (FIG. 4) provides a segregated washing area within the wash tank of the pot and pan washing machine, in which the washing action of the machine is maintained. The divider is removable and repositionable via a pair of directly opposing channels 220 extending upward from bottom wall 19 along front wall 18 and rear wall 16. Channels 220 can be included between any of jets 20. In addition multiple pairs of channels 220 can be provided within the wash tank to allow a single wash tank to be easily customizable by allowing for numerous variations of partitioning, either by repositioning a single divider 210 into different channels 220 (resulting in two segregated areas within the wash tank), or by positioning multiple dividers 210 into multiple channel pairs 220 (resulting in three or more segregated areas within the wash tank). It will be appreciated that channels 220 can be welded or otherwise attached to the interior of walls 16 and 18 such that the channels protrude from said walls, or the channels can be grooves extending into walls 16 and 18. Divider 210 is inserted into channels 220 from above the wash tank.

Figure 4:
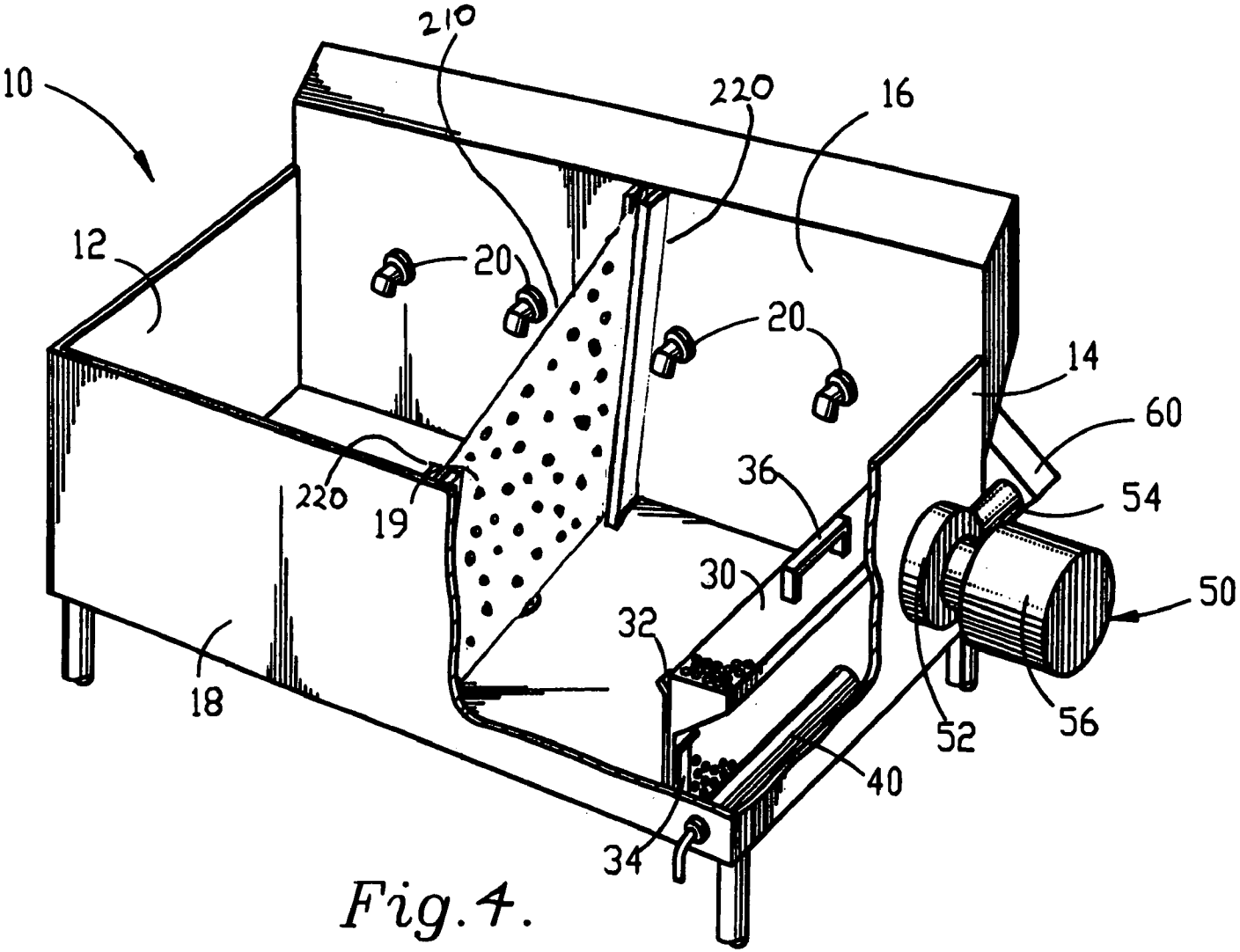
FIG. 4 is a perspective view from above of a pot and pan washing machine including the partition of the instant invention with a portion of the front and one side wall of the wash tank cut away to better illustrate certain interior construction details.
Figure 5:
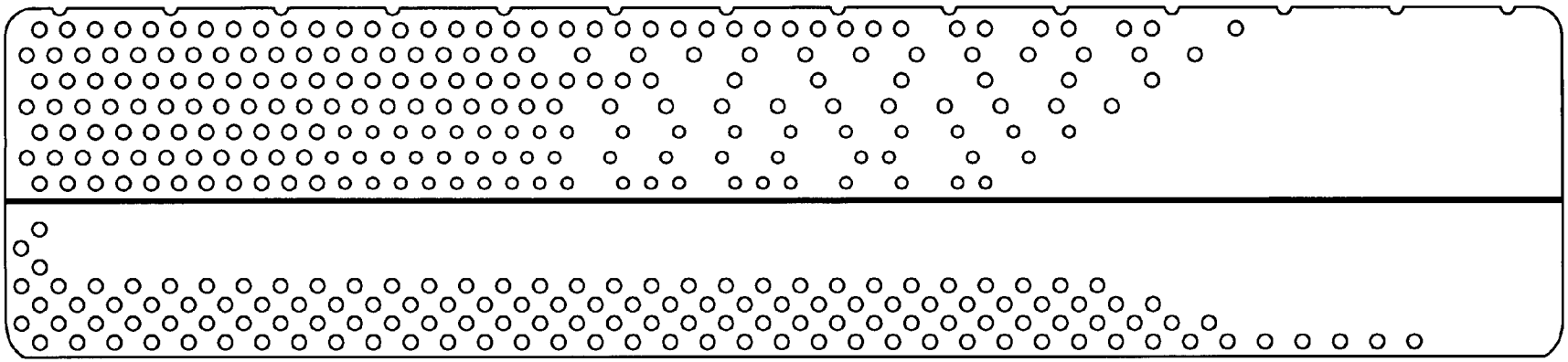
FIG. 5 shows the hole pattern of the inventive intake manifold shown in FIG. 3.

Divider 210 shown in FIG. 4 includes perforations to allow fluid to flow through the divider to intake 30. It will be appreciated that divider 210 can be a solid wall when intake manifold 130 of the instant invention is utilized. This is because intake manifold 130 extends along the entire length of rear wall 116 with perforations on each side of divider 210, and thus, fluid can be pulled into intake manifold 130 from either side of divider 210.

In operation, when divider 210 is inserted into channels 220, the washing action created by jets 20 will not be affected, and the wash action of the washing machine will be substantially maintained within the segregated areas created by divider 210.

The pot and pan washing machine of the instant invention and its components are all preferably constructed of stainless steel to increase the life of the machine; however, any other suitable material known in the art may also be utilized.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive pot and pan washing machine is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

Having thus described the invention what is claimed as new and desired to be secured by Letters Patent is as follows:

1. An intake manifold of a pot and pan washing machine, said intake manifold comprising:

an inlet adapted for associating with a pump, wherein said inlet is located in a wall of the pot and pan washing machine at least one intake surface positioned to cover said inlet, said surface including a plurality of voids, said voids being arranged such that a void concentration increases as a distance from said inlet increases.

2. The intake manifold as claimed in claim 1 wherein said at least one intake surface comprises a first surface and wherein said intake manifold further comprises a second surface, said intake manifold being positioned along a wall of the pot and pan washing machine and within a portion of a jet stream, one of said first and second surfaces extending in an inward direction generally originating from the wall along which said intake manifold is positioned at a predetermined downward angle that corresponds to a predetermined angle of the jet stream.

3. The intake manifold as claimed in claim 2 wherein the wall in which said inlet is located and the wall along which said intake manifold is positioned are two separate walls of the pot and pan washing machine.

4. The intake manifold as claimed in claim 1 wherein said at least one intake surface extends in a direction generally perpendicular to the wall in which said inlet is located.

5. The intake manifold as claimed in claim 1 further comprising at least a minimum void concentration near said inlet to eliminate swirling.

6. The intake manifold as claimed in claim 1 further comprising a maximum void concentration within a predetermined area of said surface.

7. The intake manifold as claimed in claim 6 wherein said maximum void concentration within a predetermined area of said surface increases as said distance from said inlet increases.

8. The intake manifold as claimed in claim 1 further comprising a maximum void size for any one of said plurality of voids.

9. A method of balancing the suction along an intake manifold of a pot and pan washing machine, the method comprising the steps of:

associating an intake surface with a suction source;

providing a plurality of voids in said intake surface; and increasing a concentration of said plurality of voids in said intake surface as a distance from said suction source increases.

10. A pot and pan washing machine comprising:

a wash tank;

a pump for circulating fluid within said wash tank;

at least one jet nozzle associated with an outlet of said pump for directing a jet stream in said wash tank; and an intake manifold including an inlet associated with said pump for withdrawing fluid from within said wash tank into said pump, said intake manifold including at least one intake surface including a plurality of voids extending from within said wash tank through said intake surface and into said intake manifold, said voids being arranged such that a void concentration increases as a distance from said inlet increases.

11. The pot and pan washing machine as claimed in claim 10 wherein said wash tank comprises a bottom wall, two side walls and two end walls extending upwardly from said bottom wall, said side walls being longer than said end walls.

12. The pot and pan washing machine as claimed in claim 11 wherein said inlet is located in one of said walls.

13. The pot and pan washing machine as claimed in claim 12 wherein said inlet is located in one of said end walls and said intake manifold extends along one of said side walls.

* * * * *